US010280783B2

(12) United States Patent
Philbrick et al.

(10) Patent No.: US 10,280,783 B2
(45) Date of Patent: May 7, 2019

(54) TURBOMACHINERY BLADE OUTER AIR SEAL

(71) Applicant: UNITED TECHNOLOGIES CORPORATION, Farmington, CT (US)

(72) Inventors: Graham Ryan Philbrick, Durham, CT (US); Ken Robert Lagueux, Berlin, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 310 days.

(21) Appl. No.: 15/036,256

(22) PCT Filed: Nov. 7, 2014

(86) PCT No.: PCT/US2014/064584

§ 371 (c)(1),
(2) Date: May 12, 2016

(87) PCT Pub. No.: WO2015/073321

PCT Pub. Date: May 21, 2015

(65) Prior Publication Data

US 2016/0312638 A1 Oct. 27, 2016

Related U.S. Application Data

(60) Provisional application No. 61/903,576, filed on Nov. 13, 2013.

(51) Int. Cl.

| | |
|---|---|
| ***F01D 11/12*** | (2006.01) |
| ***F01D 11/08*** | (2006.01) |
| ***F01D 5/28*** | (2006.01) |

(52) U.S. Cl.
CPC ..... *F01D 11/08* (2013.01); *F01D 5/28* (2013.01); *F01D 5/284* (2013.01); *F01D 5/288* (2013.01);
(Continued)

(58) Field of Classification Search
CPC ..... F16J 15/3204; F16J 15/328; F01D 11/08; F01D 11/12; F01D 11/122; F01D 5/28;
(Continued)

(56) References Cited

U.S. PATENT DOCUMENTS

| | | | |
|---|---|---|---|
| 4,349,313 | A | 9/1982 | Munroe et al. |
| 5,439,348 | A | 8/1995 | Hughes et al. |

(Continued)

FOREIGN PATENT DOCUMENTS

| | | | |
|---|---|---|---|
| EP | 0965730 | A2 | 12/1999 |
| EP | 2053202 | A2 | 4/2009 |
| EP | 2395129 | A1 | 12/2011 |
| FR | 2984949 | | 6/2013 |
| GB | 2061397 | | 5/1981 |

OTHER PUBLICATIONS

European Search Report, European Application No. 14861879.6, dated Jul. 28, 2017, European Patent Office; Search Report 8 pages.

(Continued)

*Primary Examiner* — Gilbert Y Lee
(74) *Attorney, Agent, or Firm* — Cantor Colburn LLP

(57) ABSTRACT

A turbomachine seal plate includes a substrate with a first material that defines a surface having a substrate width. The substrate includes a first terminus extension that is raised and extends from a terminus portion of the substrate. The first terminus extension extends outwardly relative to the surface up to a terminus extension height. The turbomachine seal plate also includes a coating having a second material that covers the surface of the substrate and defines a coating (Continued)

width. The coating abuts a side of the first terminus extension. The coating width can be substantially equal to the terminus extension height.

17 Claims, 2 Drawing Sheets

(52) U.S. Cl.
CPC ..... *F01D 11/12* (2013.01); *F01D 11/122* (2013.01); *F05D 2220/30* (2013.01); *F05D 2240/307* (2013.01); *F05D 2250/71* (2013.01); *F05D 2300/10* (2013.01); *F05D 2300/20* (2013.01)

(58) Field of Classification Search
CPC ..... F01D 5/284; F01D 5/288; F05D 2220/30; F05D 2250/71; F05D 2300/10; F05D 2300/20
See application file for complete search history.

(56) References Cited

U.S. PATENT DOCUMENTS

| | | | | |
|---|---|---|---|---|
| 2003/0107181 | A1* | 6/2003 | Wieghardt | F01D 11/02 277/415 |
| 2003/0170119 | A1 | 9/2003 | Fried | |
| 2010/0284811 | A1 | 11/2010 | Druez et al. | |
| 2016/0305266 | A1* | 10/2016 | Zywiak | F01D 11/001 |

OTHER PUBLICATIONS

International Search Report for PCT/US2014/064584; International Filing Date: Nov. 7, 2014; dated Mar. 10, 2015; 3 pgs.
International Written Opinion for International Application No. PCT/US2014/064584; International Filing Date: Nov. 7, 2014; dated Mar. 10, 2015; 8 pgs.

* cited by examiner

Fig. 1a
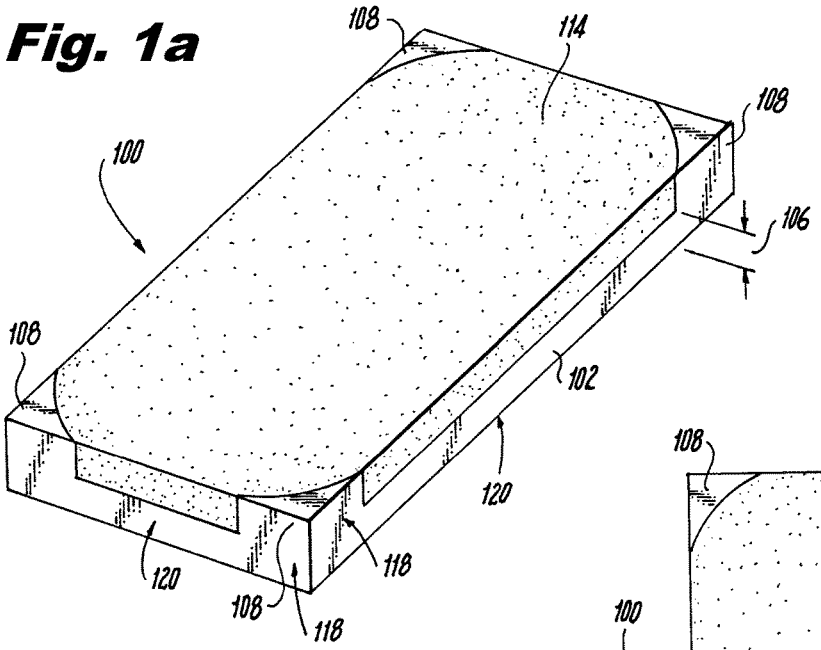
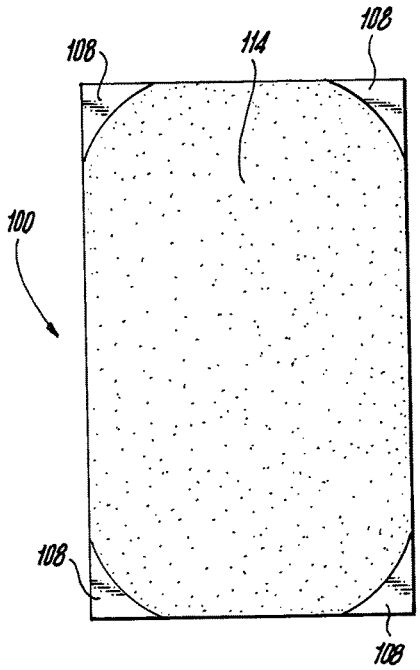
Fig. 1b
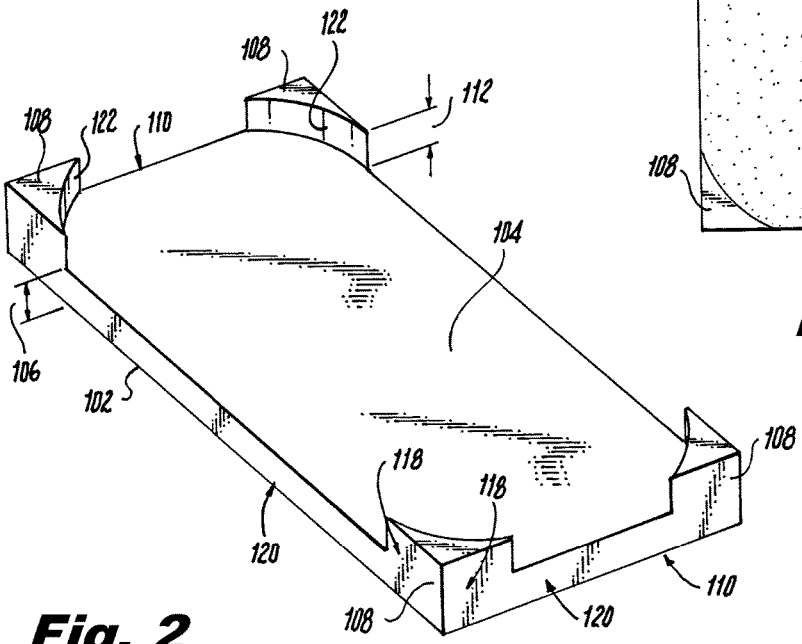
Fig. 2

Fig. 3a
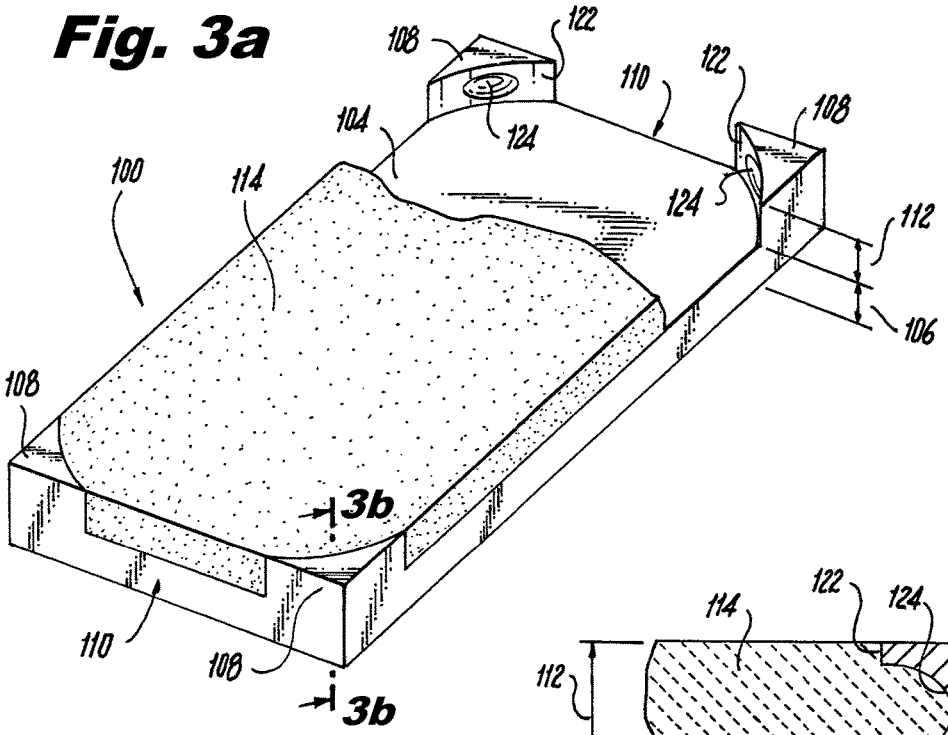
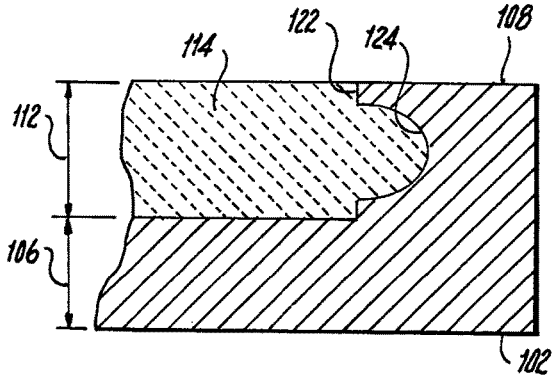
Fig. 3b
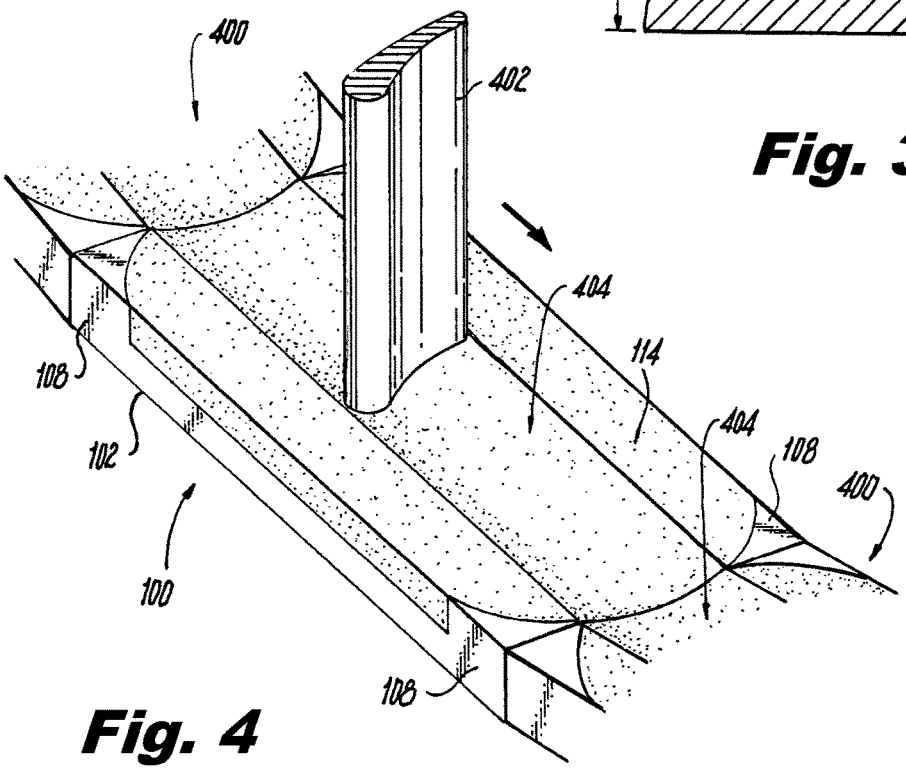
Fig. 4

TURBOMACHINERY BLADE OUTER AIR SEAL

RELATED APPLICATIONS

This application claims the benefit of and priority to U.S. Provisional Patent Application No. 61/903,576 filed Nov. 13, 2013, the contents of which are incorporated herein by reference in their entirety.

BACKGROUND

1. Field

The present disclosure relates to turbomachinery, and more particularly to blade seals for turbomachinery.

2. Description of Related Art

Blade outer air seals (BOAS) include a wearable ceramic coating for turbomachine blades to wear into for sealing purposes and to provide a thermal barrier. However, the service life can be limited due to spallation and other stress induced erosion of the coating and the seal must be replaced after such erosion to maintain a seal between each BOAS.

Such conventional methods and systems have generally been considered satisfactory for their intended purpose. However, there is still a need in the art for turbomachine blade seals that allows for improved service life and safety. The present disclosure provides a solution for these problems.

SUMMARY

In at least one embodiment of this disclosure, a turbomachine seal plate includes a substrate with a first material that defines a surface having a substrate width. The substrate includes a first terminus extension that is raised and extends from a terminus portion of the substrate. The first terminus extension extends outwardly relative to the surface up to a terminus extension height. The turbomachine seal plate also includes a coating having a second material that covers the surface of the substrate and defines a coating width. The coating abuts a side of the first terminus extension. The coating width can be substantially equal to the terminus extension height.

In at least one embodiment of this disclosure, the first material can include a metal. The second material can include a ceramic material. It is also contemplated that the first terminus extension can extend from a corner of the substrate. In at least one embodiment of this disclosure, the substrate has a second corner and includes a second terminus extension at the second corner thereof. The first terminus extension may include two outer sides that are substantially flush with two outer sides of the substrate at the corner of the substrate.

The first terminus extension and the substrate may be integral. The side of the first terminus extension that is abutted by the coating can include a curved surface. It is also contemplated that, the side of the first terminus extension that is abutted by the coating can include a recess defined therein, the recess being configured to allow the coating to extend into the recess.

In at least one embodiment of this disclosure, a turbine seal includes a plurality of turbine seal plates as described above having a first corner extension and arranged in a turbine of a turbomachine.

It is contemplated that the first corner extension can include a semi-triangular cross-section having two straight sides, each of the straight sides flush with an outer side of the substrate, and a curved side that abuts the coating. The substrate can include four corners, a second corner extension, a third corner extension, and a fourth corner extension, one of each of the first, second, third, and fourth corner extensions disposed at each of the four corners. The substrate can also include a thin wall connecting the corners extensions on one or more sides, thereby providing a wall or retaining feature for the coating that is exposed to a turbomachine blade.

In at least one embodiment of this disclosure, a method includes forming a metallic substrate having a substrate thickness and corner extensions that extend orthogonally relative to the substrate up to a corner extension height. The method also includes forming a ceramic coating on the substrate such that the ceramic coating has a ceramic coating thickness that is about equal to the corner extension height.

Forming the metallic substrate may further include forming the metallic substrate into a substantially planar shape having the corner extensions extending therefrom. In some embodiments, forming the ceramic coating further includes spraying the ceramic coating onto the metallic substrate. The substrate thickness may be formed to be about 50 to about 500 mils. The corner extension height and the ceramic coating thickness may be formed to be from about 10 mils to about 200 mils.

These and other features of the systems and methods of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices, systems, and methods of the subject disclosure without undue experimentation, embodiments thereof will be described in detail herein below with reference to certain figures, wherein:

FIG. 1A is a perspective view of an embodiment of a turbomachine seal plate in accordance with the present disclosure, showing the substrate and the coating disposed thereon;

FIG. 1B is a top plan view of the seal plate of FIG. 1A, showing the substrate and the ceramic layer having terminus extensions at the corners of the substrate;

FIG. 2 is a perspective view of a substrate of a turbomachine seal plate in accordance with the present disclosure, showing the terminus extensions extending upward from the surface of the substrate;

FIG. 3A is a perspective, cutaway view of a seal plate in accordance with the present disclosure, showing optional recesses formed in the terminus extensions;

FIG. 3B is a cross-sectional view of the substrate of FIG. 3A along line 3*b*-3*b*, showing the coating disposed inside the recess of the terminus extension; and FIG. 4 is a perspective view of a turbomachine seal in accordance with this disclosure in relation to a blade of a turbomachine.

DETAILED DESCRIPTION

Reference will now be made to the drawings wherein like reference numerals identify similar structural features or aspects of the subject disclosure. For purposes of explanation and illustration, and not limitation, an embodiment of a turbomachine seal plate in accordance with the disclosure is shown in FIGS. 1A and 1B, and is designated generally by reference character 100. Other embodiments of a turbomachine seal plate in accordance with the disclosure, or aspects thereof, are provided in FIGS. 2-4, as will be described. The apparatuses, systems, and methods described herein can be used for improved outer blade seal quality and performance in a turbomachine, for example.

As used herein, the terms "about", "substantially", or any other terms of approximation are understood by those having ordinary skill in the art to have a reasonable and definite meaning based on tolerances known in the art and the context of the disclosure to which the terms prefix.

Referring to FIGS. 1A-2, in at least one embodiment of this disclosure, a turbomachine seal plate 100 includes a substrate 102 with a first material that defines a surface 104 having a substrate width 106. The surface 104 may be substantially planar or curved to provide a desired internal contour for an internal portion of turbomachine blade stage. Also, the shape of the substrate 102 defining surface 104 may be any desired shape, including, but not limited to, substantially rectangular, square, circular, and ovular. The substrate width 106 may be any desired width and can vary between sizes of turbomachines. For example, in some embodiments, the substrate width 106 can be about 50 mils to about 500 mils. In some embodiments, the substrate width 106 is about 100 mils.

The first material of substrate 102 may include one or more metals or be comprised entirely of one or more metals, metal alloys, or any mixture thereof. In some embodiments, the first material can include one or more of cobalt, steel alloys, Ni, Ti, Ni alloy, Ti alloy, and combinations thereof. Other embodiments include any desired metal suitable for use in turbomachine blade outer air seals. The first material may have a crystalline or non-crystalline lattice structure, including a single crystal structure.

The substrate 102 includes terminus extensions 108 that are raised and extend from a terminus portion 110 of the substrate 102. The terminus extensions 108 may be of any size or shape, however it may be desired that the terminus extensions 108 be sized and shaped such that they do not interfere with a path of a turbomachine blade as described in more detail below (FIG. 4). In the embodiments shown in the Figs., the terminus extensions 108 include two outer sides 118 that are substantially flush with two outer sides 120 of the substrate 102 at a corner of the substrate 102.

The coating contact side 122 of the terminus extensions 108 may have any desired shape and number of surfaces. For example, as shown in the Figs., side 122 is a single curved surface giving a generally triangular cross-sectional profile to terminus extensions 108. However, side 122 can be any desired shape or number of surfaces, such as, but not limited to, a single straight surface (such that the cross-section of terminus extensions 108 are substantially triangular), a portion of a polygon, a plurality of curved sides, a plurality of mixed straight and curved sides, and combinations thereof. It is also contemplated that different terminus extensions on a single plate 100 may include varying shapes, sizes, and placements.

The substrate 102 can also include a thin wall (not shown) connecting the terminus extensions 108 on one or more sides, thereby providing a wall or retaining feature for the coating 114 that is exposed to a turbomachine blade.

As shown in FIGS. 1A-4, terminus extensions 108 at least partially extend outwardly relative to the surface 104 up to a terminus extension height 112. The terminus extensions 108 may be integral with the surface 104 or be attached thereto via any suitable attachment (e.g. adhesives, welding, etc.). In some embodiments, substrate 102 is formed using a mold with the terminus extensions 108 defined therein. In other embodiments, the substrate 102 is machined or milled to define surface 104 and terminus extensions 108. All suitable methods of manufacture, or combinations thereof, are contemplated to be able to create the herein disclosed devices. It is also contemplated that the terminus extensions 108 or a portion thereof can be formed of either the same material or a different material than the surface 104 of the substrate 102.

In FIGS. 1A-4, terminus portion 110 is shown as each of the corners of substrate 102. However, while described herein in the context of terminus portion 110 being corner extensions from the corners of substrate 100, it is also contemplated that the terminus portion 110 can be any portion of the substrate 102 that forms a terminus such as, but not limited to, a single edge or a portion of an edge. Moreover, while the shown and described in the context of turbomachine seal plate 100 having four terminus extensions 108 at the corners of the substrate 102, any suitable number of terminus extensions 108 may be employed, such as, one, two, three, or more.

The turbomachine seal plate 100 also includes a coating 114 having a second material that covers the surface 104 of the substrate. The second material can include any suitable ceramic material or combination of ceramic materials. For example, the ceramic can include 7% Yttria Stablized Zirconia (7YSZ).

The coating 114 defines a coating width and abuts side 122 of the terminus extensions 108. The coating 114 may be formed to have any suitable coating width. In some embodiments, the coating width can be substantially equal to the terminus extension height 112 such that the top of the coating 114 and the top of the terminus extensions 108 are flush. For example, coating width and/or terminus extension height 112 may be from about 10 mils to about 200 mils. Non-flush embodiments are also contemplated.

In some embodiments, the coating 114/terminus extensions 108 and the substrate 102 can combine to create a total seal thickness of about 50 mils to about 6000 mils.

Referring now to FIGS. 3A and 3B, the side 122 of the terminus extensions 108 that is abutted by the coating 114 may additionally include a recess 124 defined therein. The recess 124 is configured to allow the coating 114 to extend into the recess 124 in applications where the additional engagement is desired. The recess 124 may be defined by any desired shape including, but not limited to, an elliptical shape, a semi-circular shape, a lens-like shape, a rectangular shape, etc. Recesses 124 can help account for a difference in thermal expansions between the materials of the coating 114 and the substrate 102, and increase the bond strength between the substrate 102 and the coating 114 as each expand at different rates.

In at least one embodiment of this disclosure, a method includes forming a substrate 102 as described herein having terminus extensions 108 that extend orthogonally relative to the substrate up to a terminus extension height 112. The method also includes forming a coating 114 as described herein on the substrate 102.

Forming the substrate 102 may further include forming the substrate 102 into any desired shape (e.g., substantially planar, curved, etc.) having the corner extensions extending therefrom. In other embodiments, for example, substrate 102 can be cast, machined, milled, forged, additively manufactured, or the like.

In some embodiments, forming the coating 114 further includes spraying the coating 114 onto the substrate 102. The coating 114 may be disposed on the substrate 102 in any suitable manner and may be continuous or layered. In some embodiments, the coating 114 can be thicker than the terminus extension height 112, and the coating may be ground down to be flush with the terminus extensions 108.

In at least one embodiment of this disclosure, a turbine seal 400 (partly shown in FIG. 4) includes a plurality of seal plates arranged in a turbine or other bladed portion of a turbomachine. Each of the seal plates can be a seal plate 100 as described herein, or turbine seal 400 may include a mixture of seal plates 100 as described herein and conventional seal plates. Turbine seal 400 inhibits gas flow around the edges of the blades 402 of a turbomachine. In use, blades 402 contact ceramic coating 114 and may gouge a trough 404 into the coating 114. This gouging provides sealing engagement between the blade 404 and the seal plate 100. In the embodiments shown, the terminus extensions 108 are dimensioned to not contact the blade 404 during normal operation.

Corners and other terminus portions experience concentrated stress from the forces inside the turbomachine. By removing the sharp corners from the coating 114, stress experienced in the coating 114 is reduced. The substrate 102 has a higher ductility/strength than the coating 114, and therefore is able to withstand the stress concentrations in the terminus extension 108. Thus, the terminus extensions 108 reduce spallation and other stress/chemical/thermal induced erosion of the terminus portions 110 of coating 114 which allows for a more robust seal having a longer lifespan and increases safety. This is accomplished without dramatically affecting heat transfer characteristics.

The methods and systems of the present disclosure, as described above and shown in the drawings, provide for a turbomachine seal plate with superior properties including longer lifespan and increased safety. While the apparatus and methods of the subject disclosure have been shown and described with reference to embodiments, those skilled in the art will readily appreciate that one or more changes and/or modifications may be made thereto without departing from the spirit and scope of the subject disclosure.

What is claimed is:

1. A turbomachine seal plate, comprising:

a substrate including a first material and defining a surface having a substrate width, wherein the substrate includes a first terminus extension that is raised and extends from a terminus portion, the first corner extension extending outwardly relative to the surface up to a corner extension height; and a coating including a second material and covering the surface of the substrate, wherein the coating includes a coating width, the coating abutting a side of the first corner extension, wherein the substrate includes four corners, a second corner extension, a third corner extension and a fourth corner extension, one of each of the first, second third and fourth corner extensions disposed at each of the four corners.

2. The turbomachine seal plate of claim 1, wherein the coating width is substantially equal to the corner extension height.

3. The turbomachine seal plate of claim 1, wherein the first material includes a metal.

4. The turbomachine seal plate of claim 1, wherein the second material includes a ceramic material.

5. The turbomachine seal plate of claim 1, wherein the first terminus extension includes two outer sides that are substantially flush with two outer sides of the substrate at the corner of the substrate.

6. The turbomachine seal plate of claim 1, wherein the first corner extension and the substrate are integral.

7. The turbomachine seal plate of claim 1, wherein the side of the first corner extension that is abutted by the coating includes a curved surface.

8. The turbine seal plate of claim 1, wherein the side of the first corner extension that is abutted by the coating includes a recess defined therein, the recess configured to allow the coating to extend into the recess.

9. A turbine seal, comprising:

a plurality of turbine seal plates arranged in a turbine of a turbomachine, the plurality of turbine seal plates including a substrate including a first material and defining a surface having a substrate width, wherein the substrate includes a first corner extension that is raised and extends from a corner of the substrate, the first corner extension extending outwardly relative to the surface up to a corner extension height; and a coating including a second material and covering the surface of the substrate, wherein the coating defines a coating width, the coating abutting a side of the first corner extension, wherein the substrate includes four corners, a second corner extension, a third corner extension, anal a fourth corner extension, one of each of the first, second, third and fourth corner extensions disposed at each of the four corners.

10. The turbine seal of claim 9, wherein the coating width is substantially equal to the first corner extension height.

11. The turbine seal of claim 9, wherein the first corner extension includes:

a semi-triangular cross-section having two straight sides, each of the straight sides flush with an outer side of the substrate; and a curved side that abuts the coating.

12. The turbine seal of claim 11, wherein the curved side includes a recess defined therein such that the curved side is configured to allow the coating to extend at least partially into the first corner extension.

13. The turbine seal of claim 9, wherein the first material includes a metallic material and the second material includes a ceramic material.

14. A method, comprising:

forming a metallic substrate having a substrate thickness and corner extensions that extend orthogonally relative to the substrate up to a corner extension height; and forming a ceramic coating on the substrate such that the ceramic coating has a ceramic coating thickness that is about equal to the corner extension height, wherein the metallic substrate includes four corners, a first corner extension, a second corner extension, a third corner extension, and a fourth corner extension, one of each of the first, second, third, and fourth corner extensions disposed at each of the four corners.

15. The method of claim 14, wherein forming the metallic substrate further comprises forming the metallic substrate into a substantially planar shape having the corner extensions extending therefrom.

16. The method of claim 14, wherein forming the Ceramic coating further comprises spraying the ceramic coating onto the metallic substrate.

17. The method of claim 14, wherein the substrate thickness is formed to be about 50 mils to about 500 mils, and wherein the corner extension height and the ceramic coating thickness are formed to be from about 10 mils to about 200 mils.

* * * * *